US008770467B2

(12) United States Patent
Skolik et al.

(10) Patent No.: US 8,770,467 B2
(45) Date of Patent: Jul. 8, 2014

(54) DEVICE MADE FROM FOLDABLE PLANAR MATERIAL FOR FORMING COMPARTMENTS FOR RECEIVING CONTAINERS, TEMPLATE FOR FORMING THE DEVICE AND PACKAGING FORMED BY THE DEVICE

(75) Inventors: Bernard Skolik, Bassum (DE); Jens Eckermann, Bremen (DE)

(73) Assignee: Graphic Packaging International Europe Germany GmbH, Bremen (DE)

( * ) Notice: Subject to any disclaimer, the term of this patent is extended or adjusted under 35 U.S.C. 154(b) by 267 days.

(21) Appl. No.: 11/816,161

(22) PCT Filed: Jan. 9, 2007

(86) PCT No.: PCT/EP2007/000125

§ 371 (c)(1),
(2), (4) Date: Oct. 9, 2007

(87) PCT Pub. No.: WO2007/080099

PCT Pub. Date: Jul. 19, 2007

(65) Prior Publication Data

US 2008/0290147 A1 Nov. 27, 2008

(30) Foreign Application Priority Data

Jan. 10, 2006 (DE) ..... 20 2006 000 457 U

(51) Int. Cl.
*B65D 5/48* (2006.01)
*B65D 5/492* (2006.01)

(52) U.S. Cl.
USPC ..... 229/120.27; 229/120.24

(58) Field of Classification Search
USPC ..... 229/120.27, 120.24; 206/185, 186, 187, 206/188, 189, 190, 191; 217/23, 33
See application file for complete search history.

(56) References Cited

U.S. PATENT DOCUMENTS

| | | | | |
|---|---|---|---|---|
| 3,189,244 | A | 6/1965 | Whalen | |
| 3,355,012 | A | 11/1967 | Weiss | |
| 3,980,223 | A | 9/1976 | Curran | |
| 4,516,717 | A | 5/1985 | Curran | |
| 5,058,802 | A * | 10/1991 | Rutledge | 229/120.26 |
| 5,529,240 | A * | 6/1996 | Harris | 229/120.27 |
| 7,073,705 | B2 * | 7/2006 | Auclair et al. | 229/120.24 |
| 2003/0146269 | A1 | 8/2003 | Auclair | |

FOREIGN PATENT DOCUMENTS

| | | |
|---|---|---|
| DE | 93 08 075.1 | 9/1993 |
| FR | 2 779 121 | 5/1998 |
| FR | 2779121 A1 | 12/1999 |
| GB | 891685 | 3/1962 |
| NL | 7016693 | 5/1972 |
| WO | 96/06014 | 2/1996 |

* cited by examiner

*Primary Examiner* — Gary Elkins
*Assistant Examiner* — Christopher Demeree
(74) *Attorney, Agent, or Firm* — Womble Carlyle Sandridge & Rice, LLP

(57) ABSTRACT

Device made from foldable planar material for forming compartments for receiving containers comprising at least two parallel longitudinal strips and at least two transverse ribs joined via first fold lines to the longitudinal strips, transverse ribs joined to adjacent longitudinal strips being joined together in overlapping regions.

22 Claims, 11 Drawing Sheets

DEVICE MADE FROM FOLDABLE PLANAR MATERIAL FOR FORMING COMPARTMENTS FOR RECEIVING CONTAINERS, TEMPLATE FOR FORMING THE DEVICE AND PACKAGING FORMED BY THE DEVICE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a device made from foldable planar material for forming compartments for receiving containers, to a template for forming such a device and to packaging formed by such a device.

Bottles are frequently transported and stored in packaging sleeves made of cardboard. To avoid glass contact and glass breakages, the bottles are frequently arranged in the packaging sleeves in compartments and thus separated from one another. The compartments are conventionally formed by two groups of cardboard strips. The cardboard strips of the one group have slots extending from the underside which extend approximately over half the height. The cardboard strips of the other group have slots extending from the upper face which also extend approximately over half the height. The cardboard strips are fitted inside one another at the slots, so that they form a type of grid which defines the compartments.

The manufacture and assembly of the known device for forming compartments are relatively costly. The material consumption is high. More specifically, it is possible to fold up the device. Due to the different number of superimposed layers, however, it may result in uneven stacks when storing a plurality of folded-up devices on top of one another, which tend to slip and thus make usage difficult. Also the unfolding and inserting of the devices in packaging sleeves is complicated. The cardboard strips of the loosely fitted-together structure may easily fall apart from one another. As a result, fast machine speeds are prevented when inserting the device in a packaging sleeve.

Proceeding therefrom, the object of the invention is to provide a device made from foldable planar material for forming compartments for receiving containers, which has a lower material consumption and is more user-friendly. The object of the invention is further to provide a template for forming such a device. Finally, the invention relates to packaging comprising a device of the aforementioned type.

BRIEF SUMMARY OF THE INVENTION

The device according to the invention made from foldable planar material for forming compartments for receiving containers comprises at least two parallel longitudinal strips, and at least two transverse ribs joined via first fold lines to the longitudinal strips, transverse ribs joined to adjacent longitudinal strips being joined together in overlapping regions.

According to one embodiment, the device comprises at least one transverse strip joined via two fold lines to two adjacent longitudinal strips. According to a further embodiment, the device comprises at least one transverse strip joined via transverse ribs to two adjacent longitudinal strips. In principle, the device may, however, also be designed without transverse strips, the parallel longitudinal strips only being joined together via the transverse ribs overlapping one another.

The device according to the invention is based on longitudinal strips which are able to be joined together at an adjacent end via a transverse strip. By means of the longitudinal strips, bottles or other containers located next to one another in rows are able to be separated from one another. Moreover, the device comprises transverse ribs which make it possible to separate from one another containers arranged adjacent to one another in the rows. Additionally a separation of containers in the rows by the transverse strips is possible at the end of the longitudinal strips. Said construction avoids a plurality of additional transverse strips, which conventionally are fitted together with the longitudinal strips to form compartments. It is, however, possible to stamp out the transverse ribs from the material of the longitudinal strips and to fold out said transverse ribs to form the compartments from the longitudinal strips. Optionally, at least one transverse strip is folded along the second fold line transversely to the longitudinal strips. As a result, the material consumption for forming the device is reduced approximately by half relative to conventional devices. Additionally, as transverse ribs joined to adjacent longitudinal strips are joined together in the overlapping region, it is achieved that adjacent longitudinal strips are joined together in an articulated manner by at least one transverse rib. This makes it possible to erect the device from a planar folded-up state into a stable configuration which comprises the compartments for receiving the containers. In this connection, the transverse ribs in the folded-up state of the device may be folded back into the recesses of the longitudinal strips, from which they are stamped-out. As a result, large accumulations of material and an uneven distribution of layers in the stack of folded-up devices are avoided. As a result, the insertion of the device into a packaging sleeve is also simplified. When the transverse ribs are rigidly joined together in the overlapping regions, the device is stable so that it does not fall apart when inserted into the outer. As a whole, a considerable material saving is achieved and the potential processing speeds are increased and the reliability of the process is considerably improved.

In principle, the longitudinal strips may be provided on only one side with transverse ribs, which define compartments on only one side of the longitudinal strips. Preferably, transverse ribs defining compartments are present on both sides of the longitudinal strips.

According to one embodiment, at least one transverse rib is joined in an interruption of the first fold line to a further transverse rib. The transverse ribs joined together define on both sides of the same longitudinal strip one side of a compartment. As a result, it is possible to form the compartments in a particularly material saving manner.

In principle, the transverse ribs may be parts which are originally separate from the longitudinal strips which are rigidly joined to the longitudinal strips by forming a fold line between the longitudinal strips and the transverse ribs. In this connection, a saving in material is already possible, for example by transverse ribs being used which, for example, have a lower height than the longitudinal strips. According to a preferred embodiment, which is particularly material-saving, at least one transverse rib is stamped-out from a longitudinal strip.

The overlapping regions between the transverse ribs may be of varying configuration. For example, a transverse rib may have a zigzag or wave-shaped edge region which overlaps the adjacent transverse rib. According to one embodiment, at least one overlapping region comprises a tongue, tab or further projection which projects from a transverse rib. According to a further embodiment, a complementary stamped-out portion of a transverse rib is associated with the projection which is adjacent to the transverse rib bearing the tongue in the same longitudinal strip. In this embodiment and in other embodiments of the overlapping region, advantageously the projection of the overlapping region is obtained from a stamped-out portion of an adjacent transverse rib of the same longitudinal strip.

The join in the overlapping region may, for example, be a plug-in connection between a tongue provided with a barb of the one transverse rib and an insertion slot of the other transverse rib. According to a further embodiment, the transverse ribs are joined together by bonding. This is particularly advantageous in terms of technical production and leads to a rigid connection of the transverse ribs to one another and thus to a stable configuration of the device.

According to one embodiment, the longitudinal strips respectively comprise a plurality of transverse ribs. As a result, a plurality of compartments may be provided by a single device.

According to one embodiment, the transverse strip comprises at least one portion which is joined in an interruption of the first and/or the second fold line to a transverse rib. In this embodiment, a transverse rib is present in the extension of the transverse strip and which defines an additional compartment on one side. Preferably, the transverse strip is joined at both ends to one respective transverse rib. According to one embodiment, the entire transverse strip at the two ends is joined via the transverse ribs and the first fold lines to the adjacent longitudinal strips. According to a further embodiment, only one portion of the transverse strip is joined via the transverse ribs and the first fold lines to the adjacent longitudinal strips. At least one further portion of the transverse strip is joined via two fold lines to the adjacent longitudinal strips.

According to a further embodiment, at least one longitudinal strip has an end region which projects from the second fold line of an adjacent transverse strip and/or from the first fold line of an adjacent transverse rib. The end region defines, in addition to the transverse strip and/or in addition to the transverse rib, a further compartment on one side. In principle, the device may also be designed without a projecting end region of the longitudinal strips. The transverse strip and/or the transverse rib on the end face may therefore be supported on the inside of a packaging sleeve.

According to a further embodiment, the end region projects from the second fold line and/or from the first fold line by a spacing corresponding to the diameter of a container. The end region with such dimensions may be supported on the inside of a packaging sleeve, so that the device is correctly positioned relative to the packaging sleeve at this point.

To this end, preferably the two outer longitudinal strips respectively comprise at least one end region projecting by a spacing corresponding to the diameter of a container. When the two outer longitudinal strips respectively have at both ends such an end region, said longitudinal strips may be supported in a packaging sleeve, so that the compartments are always correctly configured. According to a further embodiment, the projecting end regions of the outer longitudinal strips diagonally oppose one another. Preferably, the two projecting end regions are located at the ends onto which the restoring forces act which load the device in the folded-up position. As a result, the device is held in a stable manner in a packaging sleeve, in a configuration in which containers may be inserted into the compartments.

According to a further embodiment, the overlap of the end region is less than the diameter of a container. This embodiment is advantageous, in particular when the device is filled with containers before inserting into a packaging sleeve, as it may be inserted more easily into the outer.

According to one embodiment, at least one transverse rib which is joined to an externally arranged longitudinal strip, has a maximum overlap over the first fold line joining the transverse rib to the longitudinal strip which corresponds to the diameter of a container. As a result, it is also possible to position the device via the transverse rib in the correct position in a packaging sleeve.

According to a further embodiment, the outer longitudinal strips respectively comprise at least two transverse ribs with a corresponding overlap. This makes it possible to hold the device in a packaging sleeve securely in the correct position, even in the transverse direction, which allows easy insertion of bottles. According to a further embodiment, the transverse ribs are present with the corresponding overlap only on two diagonally opposing end regions of the longitudinal strips. With correspondingly directed restoring forces, therefore, the device is fixed in the desired arrangement.

According to a further embodiment, the overlaps of the transverse ribs are less than the diameter of a container. This embodiment is advantageous, in particular when the device is filled with containers before inserting into a packaging sleeve, as it may be inserted more easily into the packaging sleeve.

In principle, there may be any number of longitudinal strips of the device. With regard to increased packaging sizes, the device according to one embodiment has two or three longitudinal strips.

In principle, there may also be any number of transverse strips. With regard to increased packaging sizes, according to one embodiment one or two transverse strips are present.

According to one embodiment, the device is folded up so that adjacent longitudinal strips are located on top of one another and transverse ribs are folded in at least partially into the longitudinal strips to which they are joined. This allows space-saving storage and easy transport as well as advantageous preparation for the insertion into a packaging sleeve.

According to one embodiment, the device is erected such that the transverse ribs and optionally the at least one transverse strip are arranged transversely to the longitudinal strips. In this configuration, the device is ready for receiving containers.

In principle, the device may define any number of compartments. According to one embodiment, with regard to increased packaging sizes it defines six, nine, twelve, sixteen, eighteen, twenty or twenty-four compartments.

In principle, different materials are considered for the device, for example a plastics material or corrugated board. According to one embodiment, the device is made of cardboard.

According to one embodiment, a template for forming a device of the aforementioned type comprises a strip made from a foldable planar material which has at least two first and/or second fold lines oriented perpendicular to its longitudinal direction, which themselves and/or the imaginary extensions thereof respectively define a longitudinal strip on one side and a transverse strip on both sides, which in each longitudinal strip comprises at least one first fold line extending perpendicular to the longitudinal direction, a stamped-out portion defining a transverse rib extending from the ends thereof, transverse ribs of adjacent longitudinal strips of which the first fold lines have the same spacing from the transverse strip, being extended in the longitudinal direction of the strip by spacings from their first fold lines, the sum of which exceeding the width of the adjacent transverse strip.

According to one embodiment, the transverse strip or at least one portion of the transverse strip is joined via the second fold lines to the longitudinal strips. According to one embodiment, the first fold lines defining the transverse strip are interrupted, and stamped-out portions defining transverse ribs in the longitudinal strips extend from the outer ends of the first fold lines, which transverse ribs are joined between the inner ends of the first fold lines to the transverse strip or a portion of the transverse strip.

The template according to the invention is advantageously configured in one piece, but may also be formed from a plurality of pieces. It may be produced in a simple stamping process from a web material or sheet material. For the production of the packaging from the template, the transverse ribs merely have to be joined together in the overlapping regions, for which, for example, plug-in connections or adhesive connections may be produced. The fold lines are, for example, configured as interrupted stamped lines, rupture lines or score lines.

According to one embodiment, at least two transverse ribs are articulated on a longitudinal strip via an interrupted first fold line, a transverse rib being defined by a stamped line which extends from the outer ends of the interrupted first fold line and a further transverse rib being defined by a further stamped line which extends from the inner ends of the same interrupted first fold line and extends to the other side of the interrupted first fold line. In the aforementioned manner, the longitudinal strip is designed with transverse ribs which may be folded onto different sides of the longitudinal strip.

According to a further embodiment, in at least one longitudinal strip adjacent transverse ribs have at least one tongue or tab or other projection projecting in the longitudinal direction and a stamped-out portion receiving said tongue or tab or other projection. The tab or other projection form a part of an overlapping region which may be joined to a transverse rib of an adjacent longitudinal strip. In this template, the overlapping region is made possible at particularly low cost.

According to one embodiment, the first and/or second fold lines, which define a transverse strip, are interrupted fold lines, stamped-out portions extending from the inner and/or outer ends thereof which define a projecting end region of the longitudinal strips. In this embodiment, the projecting end region is advantageously obtained from the transverse strip.

According to one embodiment, the first and/or second fold lines which define a transverse strip or a portion of the transverse strip have an interrupted central region, from the inner ends thereof a portion of the transverse strip extends, and from the outer ends thereof stamped-out portions extend which define transverse ribs in the longitudinal strips. In this template, transverse ribs may be advantageously folded out in the extension of the transverse strip from the adjacent longitudinal strips.

For the choice of material of the template, the aforementioned material is suitable for the device. According to a preferred embodiment the template consists of cardboard.

The invention further relates to packaging comprising a packaging sleeve made from foldable planar material containing at least one device of the aforementioned type.

According to one embodiment, the packaging sleeve is substantially cuboid. Designs of the packaging sleeve are included which, by adapting to the upper region of the bottles, taper upwardly in the upper region in at least one vertical plane.

According to one embodiment, the device is joined via tabs on the end face on longitudinal strips and/or on transverse ribs to the packaging sleeve. As a result, immovable positioning of the device in the packaging sleeve is achieved in all directions, in particular also in the vertical direction.

The tabs may, for example, be supported only on the inner faces of the packaging sleeve. They may, however, also have a plug-in connection with the packaging sleeve.

According to one embodiment, the tabs are joined to the packaging sleeve via bonding.

According to one embodiment, the side walls of the packaging sleeve are joined together by fold lines and the packaging sleeve is folded to form a sleeve which lies flat and in which the folded-up device is arranged. In this manner, the packaging sleeve together with the device contained therein which forms compartments may be delivered to the user who erects the packaging and packs in the containers.

Space-saving storage and transport in stacks is possible. Also, mechanical removal from the stack may be carried out mechanically at high speed. The base of the packaging sleeve is, for example, provided with a longitudinally oriented base fold, so that the base is automatically straightened out when the packaging is erected. It is, however, also possible to use an insert base or a base with a plurality of base flaps which still has to be closed in the packaging process. The same applies to the lid which, however, may be closed during the packaging process only after inserting the containers.

According to one embodiment, the packaging sleeve and the device are aligned.

According to a further embodiment, the packaging sleeve consists of cardboard. Other materials may be considered, in particular, corrugated card. In principle, other foldable planar materials are also possible, such as plastics material.

According to a further embodiment, containers are inserted into the compartments formed by the device. According to a further embodiment, the containers are bottles.

BRIEF DESCRIPTION OF THE VIEWS OF THE DRAWINGS

The invention is described hereinafter in more detail with reference to the accompanying drawings of embodiments, in which.

DETAILED DESCRIPTION OF THE INVENTION

Figure 1:
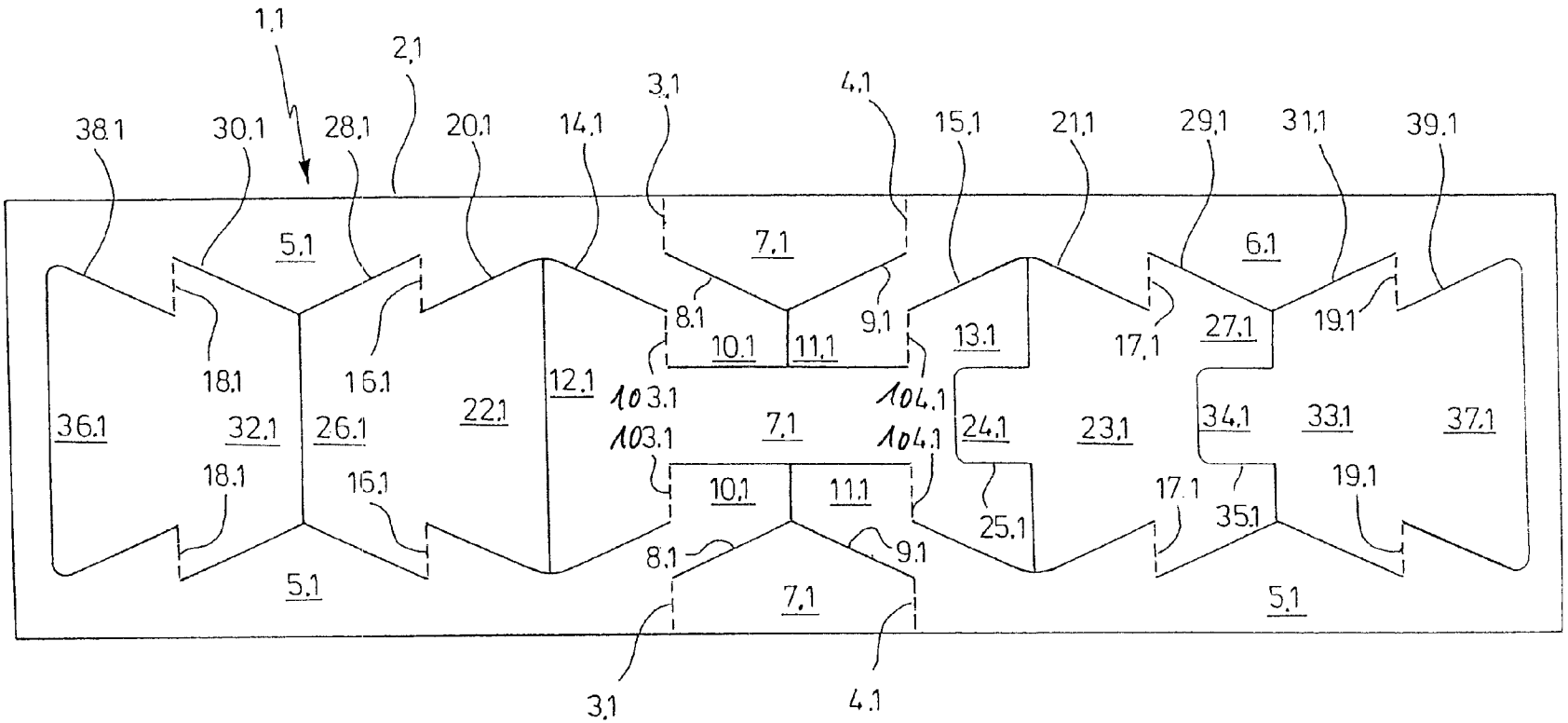
FIG. 1 shows a template for a device for twelve bottles spread out flat in plan view.

While this invention may be embodied in many different forms, there are described in detail herein a specific preferred embodiment of the invention. This description is an exemplification of the principles of the invention and is not intended to limit the invention to the particular embodiment illustrated In the following description of different embodiments, elements of the construction corresponding to one another are denoted by the same reference numerals. In the respective embodiment, reference is made by a point placed after the reference numeral and a subsequent numeral which denotes the respective embodiment. Optionally, elements which occur repeatedly in a construction are characterized by an upstroke.

The template 1.1 of FIG. 1 is formed from a strip 2.1 made of cardboard. It comprises in the vicinity of its transverse centre axis two interrupted, parallel first fold lines 103.1, 104.1 and second fold lines 3.1, 4.1.

Outside the first and second fold lines 103.1, 104.1, 3.1 and 4.1 longitudinal strips 5.1 and 6.1 are present. Between the fold lines 103.1, 104.1, 3.1, 4.1 portions of a transverse strip 7.1 are arranged.

The second fold lines 3.1 and 4.1 have outer portions, i.e. extending from the longitudinal side edges of the strip 2.1, from the inner ends of which stamped-out portions 8.1, 9.1 extend. The stamped-out portions 8.1, 9.1 extend respectively approximately as far as the transverse centre axis of the strip 2, 1, then partially along the transverse centre axis towards the longitudinal centre axis and then extend respectively parallel to the longitudinal centre axis of the strip 2.1 back to the first fold lines 103.1, 104.1, said stamped-out portions coming into contact on the inner ends of the first fold lines 103.1 and 104.1. The stamped-out portions 8.1, 9.1 thus define projecting end regions 10.1 and 11.1 of the longitudinal strips 5.1 and 6.1.

The central, strip-shaped portion of the transverse strip 7.1 is joined on both sides via interruptions of the first fold lines 103.1 and 104.1 to transverse ribs 12.1, 13.1. The transverse ribs 12.1, 13.1 are defined inside the longitudinal strips 5.1 and 6.1 by stamped-out portions 14.1, 15.1 which join the outer ends of the first fold lines 103.1 and 104.1 together. The stamped-out portions 14.1, 15.1 are respectively substantially trapezoidal, the narrower parallel side being joined to the strip-shaped central portion of the transverse strip 7.1.

In the longitudinal strips 5.1 and 6.1 respectively two further interrupted first fold lines 16.1, 17.1, 18.1, 19.1 are present. The further first fold lines 16.1, 17.1, 18.1, 19.1 are parallel to the first fold lines 103.1, 104.1 and the second fold lines 3.1, 4.1.

The inner ends of the first fold lines 16.1, 17.1 are respectively joined together by stamped-out portions 20.1, 21.1, each stamped-out portion 20.1, 21.1 defining a substantially trapezoidal transverse rib 22.1, 23.1. The transverse ribs 22.1, 23.1 are joined by their narrow parallel sides to the first fold lines 16.1, 17.1. The wide parallel sides face the transverse ribs 12.1, 13.1. The transverse rib 23.1 has a tab 24.1 oriented away from the first fold line 17.1, which is defined by a stamped-out portion 25.1 in the base of the transverse rib 13.1.

The transverse ribs 22.1, 23.1 are joined to further transverse ribs 26.1, 27.1 through the interruption of the first fold lines 16.1, 17.1, which are arranged on the other sides of the first fold lines 16.1, 17.1. The further transverse ribs 26.1, 27.1 are also defined by trapezoidal stamped-out portions 28.1, 29.1 which have their wide parallel side on the first fold lines 16.1, 17.1. The stamped-out portions 28.1, 29.1 respectively join the outer ends of the portions of the first fold line 16.1, 17.1.

From the outer ends of the first fold lines 18.1, 19.1 stamped-out portions 30.1, 31.1 extend which define the transverse ribs 32.1, 33.1. The transverse ribs 32.1, 33.1 are trapezoidal, their wide parallel sides falling within the first fold lines 18.1, 19.1. Their narrow parallel sides are in contact with the narrow parallel sides of the further transverse ribs 26.1, 27.1. In this connection, the transverse rib 33.1 has a substantially right-angled tab 34.1 facing away from the further fold line 19.1, which is defined by a stamped-out portion 35.1 in the further transverse rib 27.1.

Finally, the transverse ribs 32.1, 33.1 are joined through the interruptions of the first fold lines 18.1, 19.1 to further transverse ribs 36.1, 37.1 which are arranged on the other sides of the first fold lines 18.1, 19.1. The further transverse ribs 36.1, 37.1 are also trapezoidal, the narrow parallel sides falling within the further fold lines 18.1, 19.1. They are defined by stamped-out portions 38.1, 39.1 which extend from the inner ends of the portions of the first fold lines 18.1, 19.1.

To form a device for forming compartments, the longitudinal strip 2.1 is folded about the fold line 3.1 against the transverse strip 7.1 and the longitudinal strip 6.1. In this connection, the inner sides of the tabs 24.1 and 34.1 are bonded to the inner sides of the transverse ribs 26, 1 and 36.1 in contact therewith.

Figure 2:
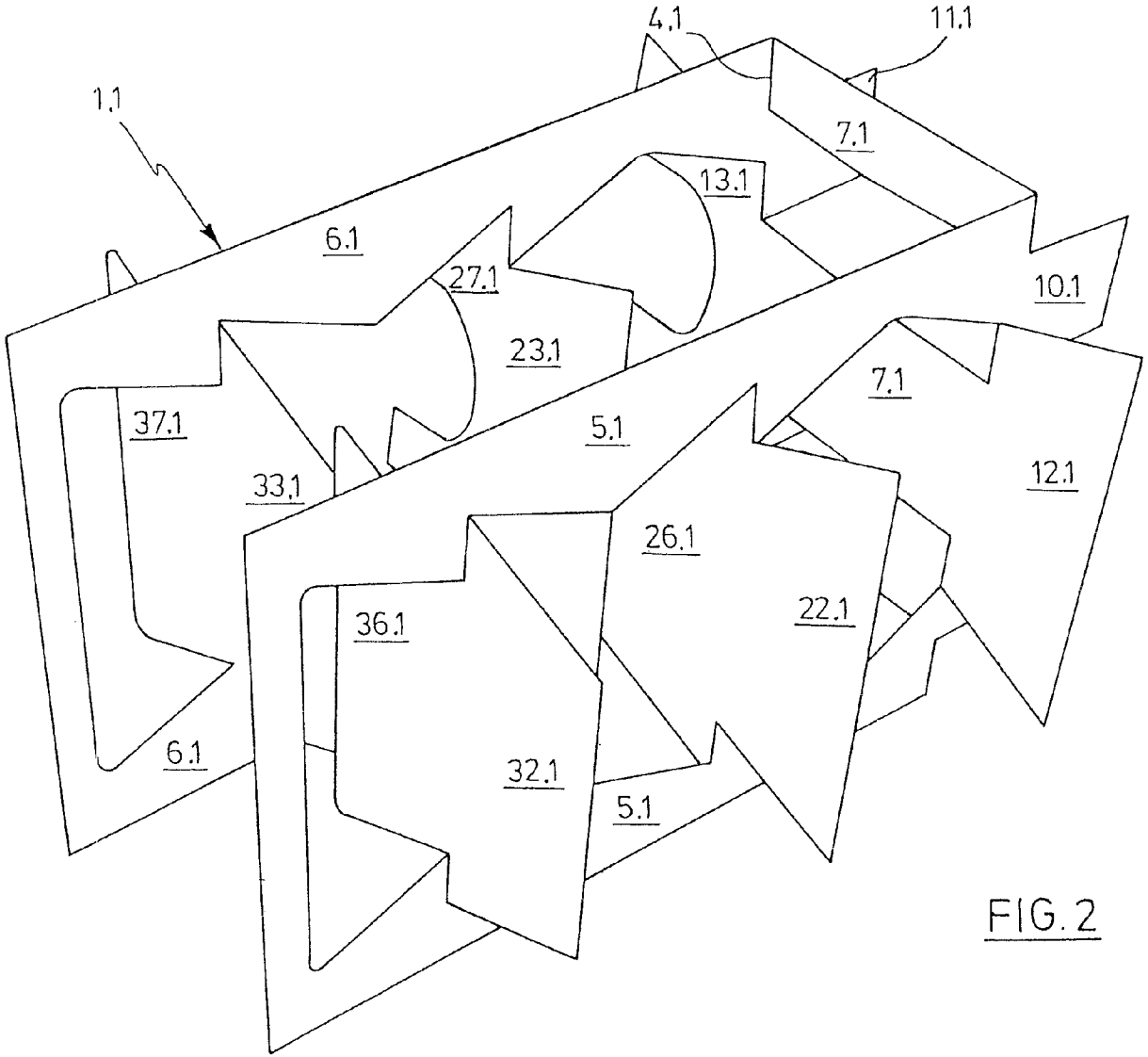
FIG. 2 shows the device formed from the template of FIG. 1 in a perspective view obliquely from above and from the side.

According to FIG. 2, the device is folded out from the aforementioned, flat folded-up state by the transverse strips 7.1 being pivoted about the fold line 4.1 perpendicular to the longitudinal strip 6.1. In this connection all transverse ribs 12.1, 22.1, 26.1, 32.1, 36.1 pivot automatically in an orientation perpendicular to the longitudinal strip 5.1. Moreover, in this case the transverse ribs 13.1, 23.1, 27.1, 33.1 and 37.1 automatically pivot transversely to the longitudinal strip 6.1.

The device is arranged in this configuration in a packaging sleeve, not shown.

Between the longitudinal strips 5.1 and 6.1, compartments are defined by the longitudinal strip 7.1 as well as the inwardly pivoted transverse ribs 26.1, 23.1 and 36.1 and 33.1. At the end at which the longitudinal strips 5.1, 6.1 are not joined together by transverse strips, a further compartment is additionally defined by a wall of the packaging sleeve, not shown. On the two outer faces of the longitudinal strips 5.1 and 6.1, compartments are also defined between the longitudinal strips 5.1 and 6.1, the outwardly projecting transverse ribs 12.1, 22.1, 32.1 as well as 13.1, 27.1 and 37.1 and the walls of the packaging sleeve. At the end of the device which comprises the transverse strip 7.1, a further compartment is defined between the transverse strip 7.1 and the end portions 10.1 and 11.1 as well as the wall of the packaging sleeve.

Moreover, one respective compartment is defined between the walls of the packaging sleeve and the end portion 10.1 as well as the transverse rib 12.1 and/or the end portion 11.1 and the transverse rib 13.1.

The device, together with a packaging sleeve accommodating said device, thus forms twelve compartments.

Figure 3:
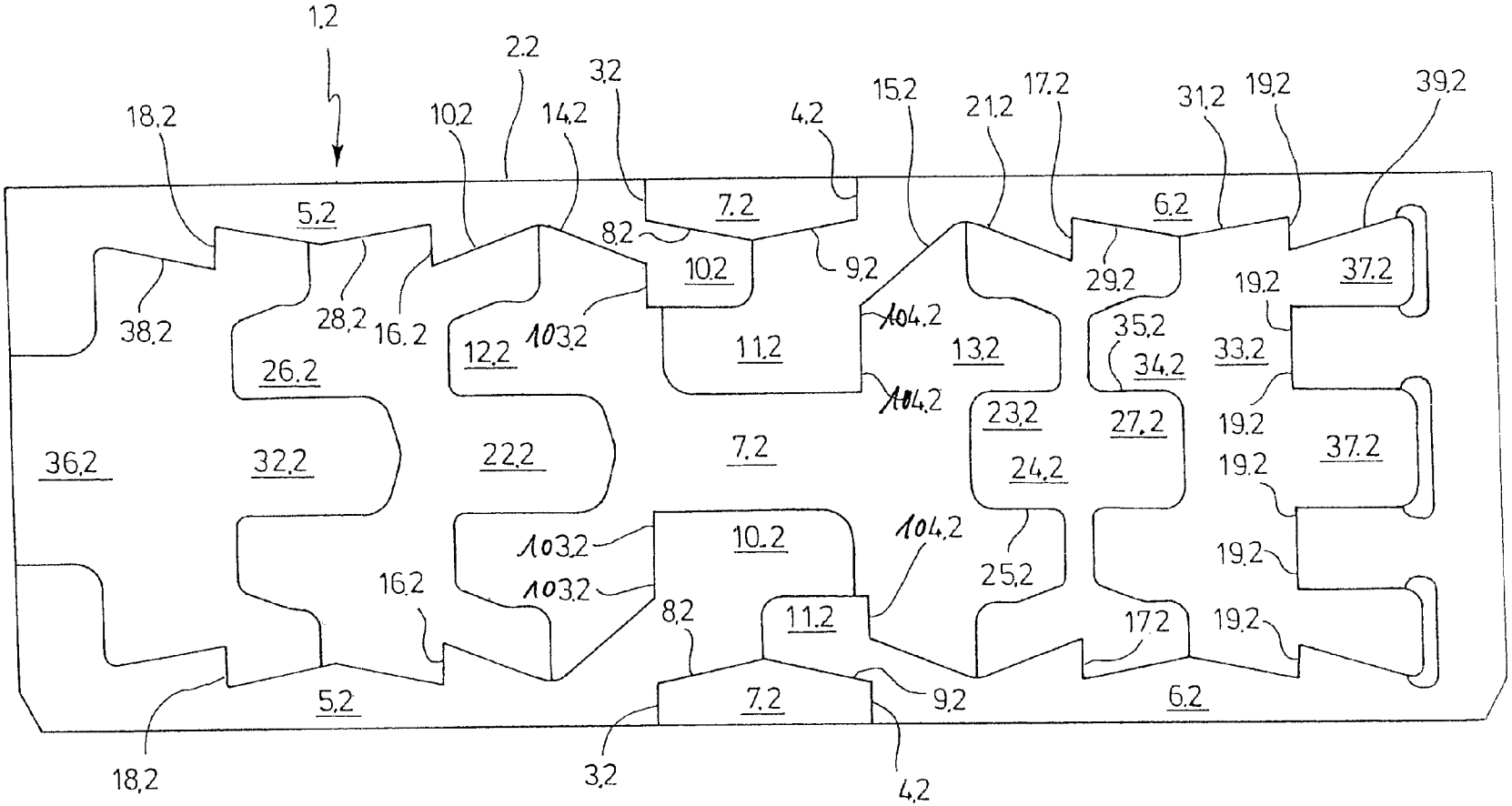
FIG. 3 shows a further template for a device for twelve bottles spread out flat in plan view.
Figure 4:
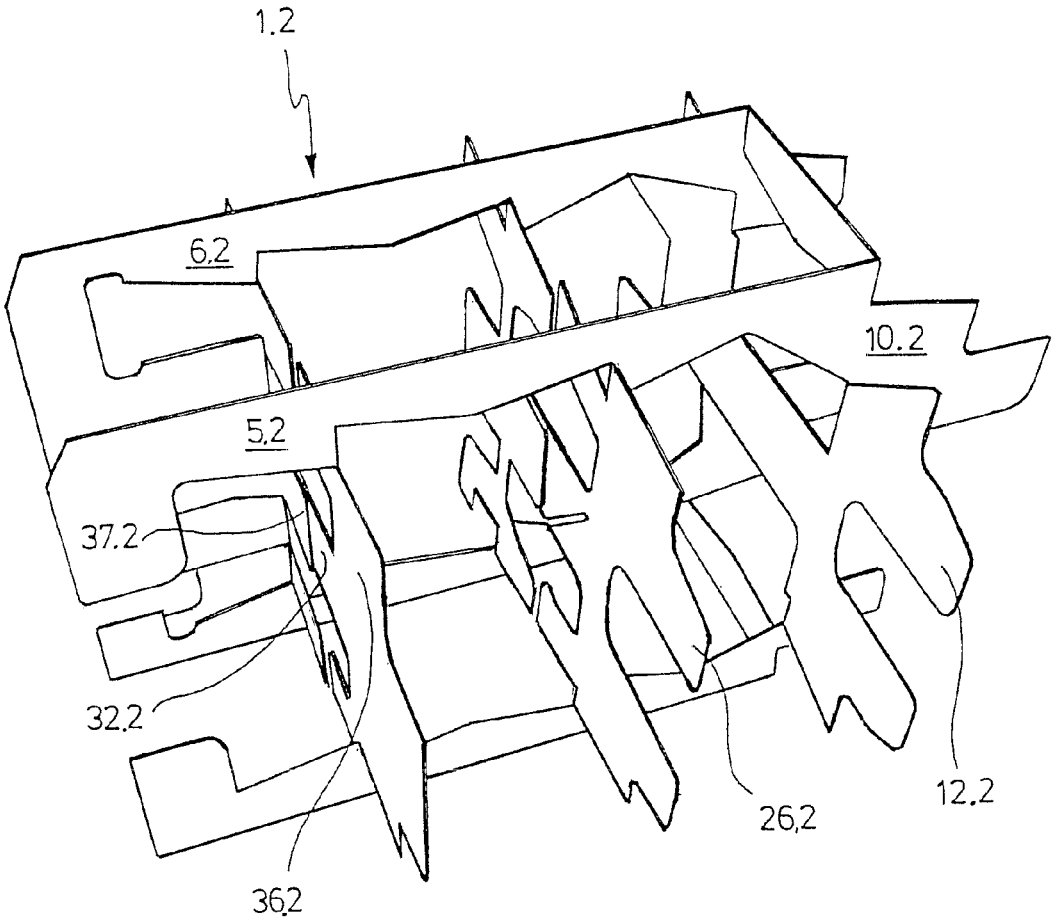
FIG. 4 shows a device formed from the template of FIG. 3 in a perspective view obliquely from above and from the side.

The template 1.2 of FIG. 3 differs from the template 1.1 of FIG. 1 by the extent of the stamped-out portions which define the transverse strip 7.2 as well as the transverse ribs 12.2, 13.2, 22.2, 23.2, 26.2, 27.2, 32.2, 33.2 and 36.2, 37.2. As a result, in the device according to FIG. 4 it is achieved that the longitudinal strips 5.2 and 6.2 and the terminal transverse ribs 12.2, 13.2 as well as 36.2, 33.2 project outwardly, approximately by the diameter of a bottle. In these regions, the device is supported on the inner face of a packaging sleeve, not shown. As a result, it is ensured that the device is positioned such that the bottles may be easily inserted into the compartments.

Figure 5:
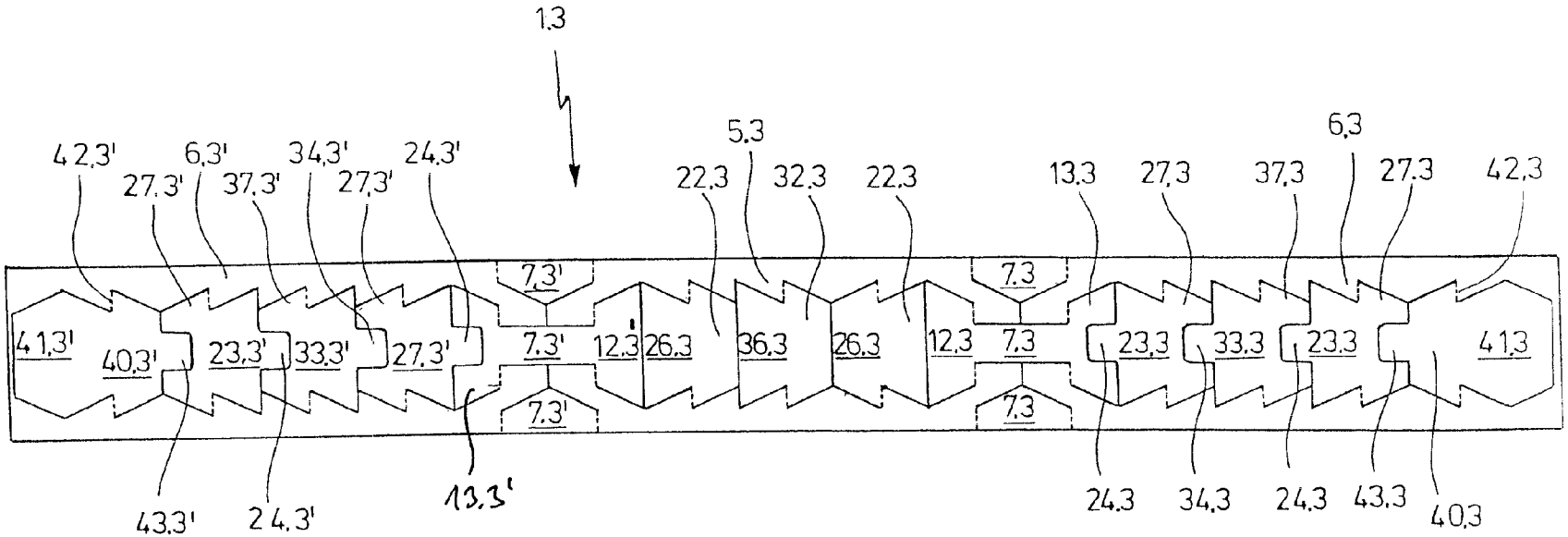
FIG. 5 shows a template for a device for twenty-four bottles spread out flat in plan view.

FIG. 5 shows a template 1.3 which differs from the template 1.1 according to FIG. 1 in that in the longitudinal strip 5.3 the arrangement of the transverse ribs 22.3, 26.3 is present twice and in the longitudinal strip 6.3 the arrangement of the transverse ribs 23.3, 27.3 is also present twice. In the longitudinal strip 6.3 is also an arrangement of two transverse ribs 40.3, 41.3 which may be folded about a further interrupted first fold line 42.3.

On the other side of the longitudinal strip 5.3 a plurality of interrupted second fold lines 3.3', 4.3' are located which laterally define a transverse strip 7.3'. The transverse strip 7.3' has a transverse rib 12.3' which is stamped out from the longitudinal strip 5.3.

On the other side of the central portion 7.3' the longitudinal strip 6.3' is configured as a mirror image to the longitudinal strip 6.3.

For pre-bonding, the inner face of the longitudinal strip 5.3 is folded against the inner face of the longitudinal strip 6.3 and the tabs 24.3, 34.3, 43.3 are bonded to the transverse ribs folded thereagainst. Subsequently, the outer face of the longitudinal strip 6.3' is folded against the outer face of the longitudinal strip 5.3 and the tabs 24.3', 34.3', 43.3' are bonded to the transverse ribs resting thereagainst.

Figure 6:
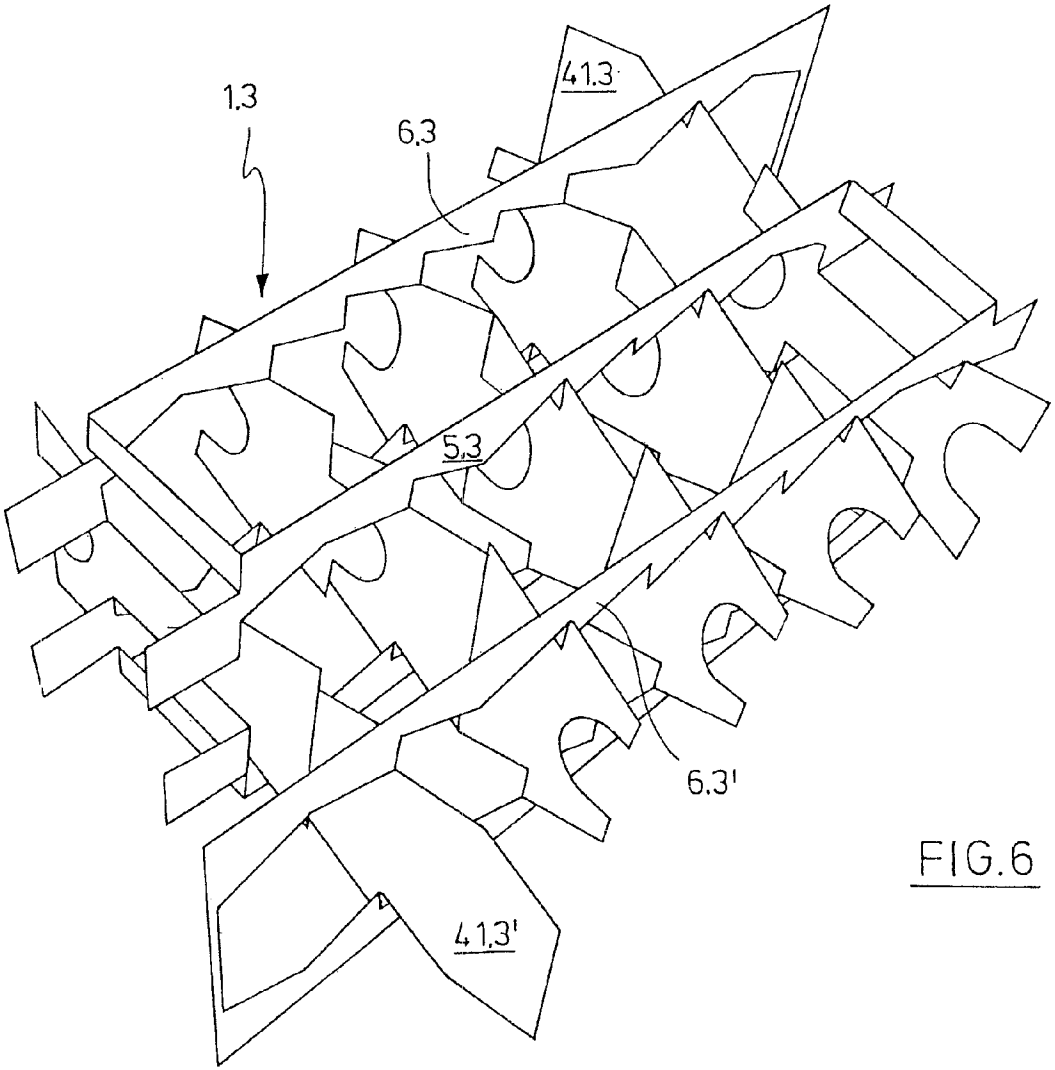
FIG. 6 shows a device formed from the template of FIG. 5 in a perspective view obliquely from above and from the side.

The device may be ejected subsequently by pressing against the ends of the longitudinal strips 6.3, 6.3' which are not joined to transverse strips, as shown in FIG. 6.

Figure 7:
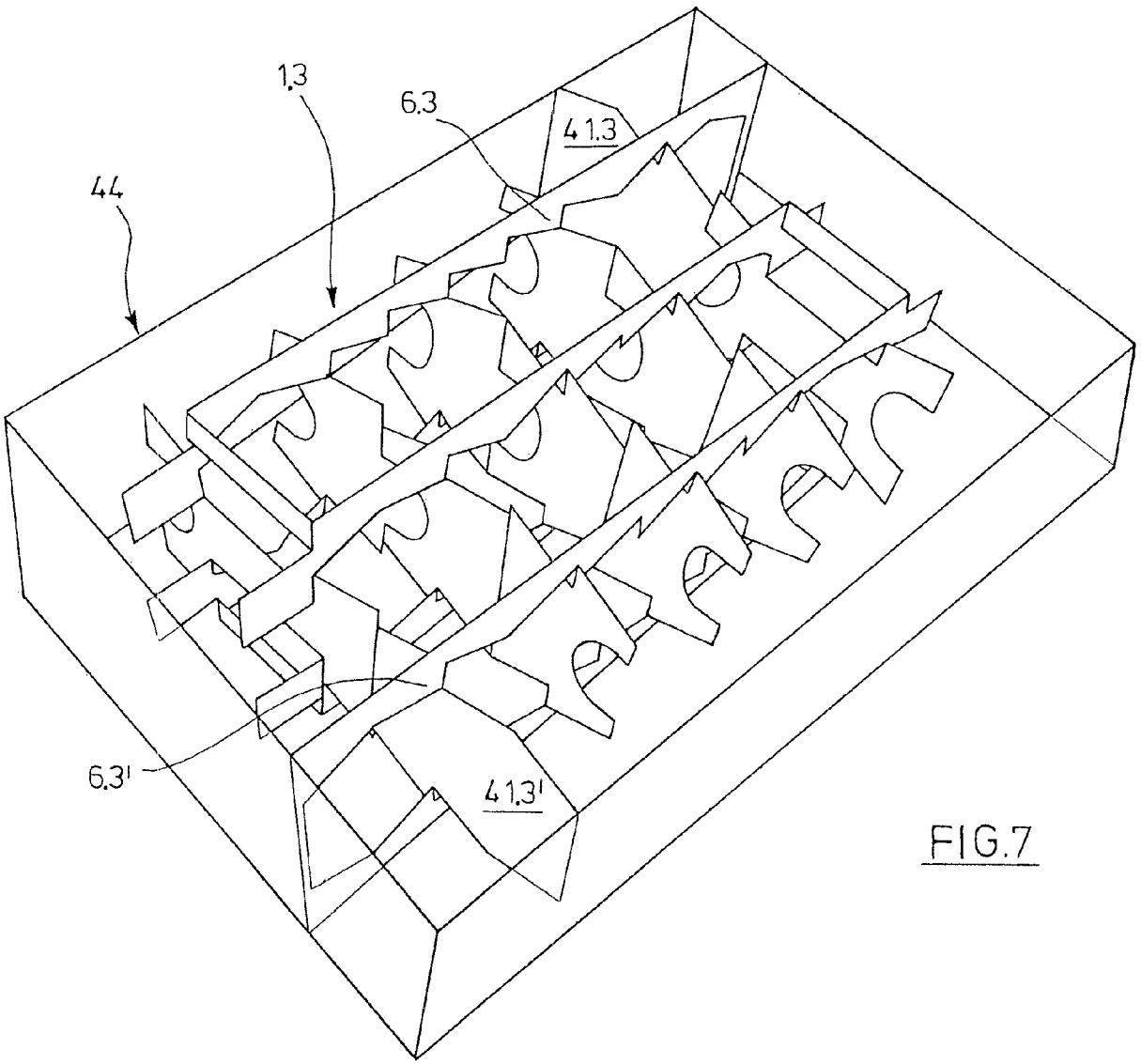
FIG. 7 shows the device according to FIG. 6 in a packaging sleeve.

According to FIG. 7 the device 1.3 defines in a cuboid packaging sleeve 44 a total of twenty-four compartments. In this case, it is supported on inner walls of the packaging sleeve, by the end regions of the longitudinal webs 6.3', 6.3 and the adjacent transverse ribs 41.3, 41.3'.

Figure 8:
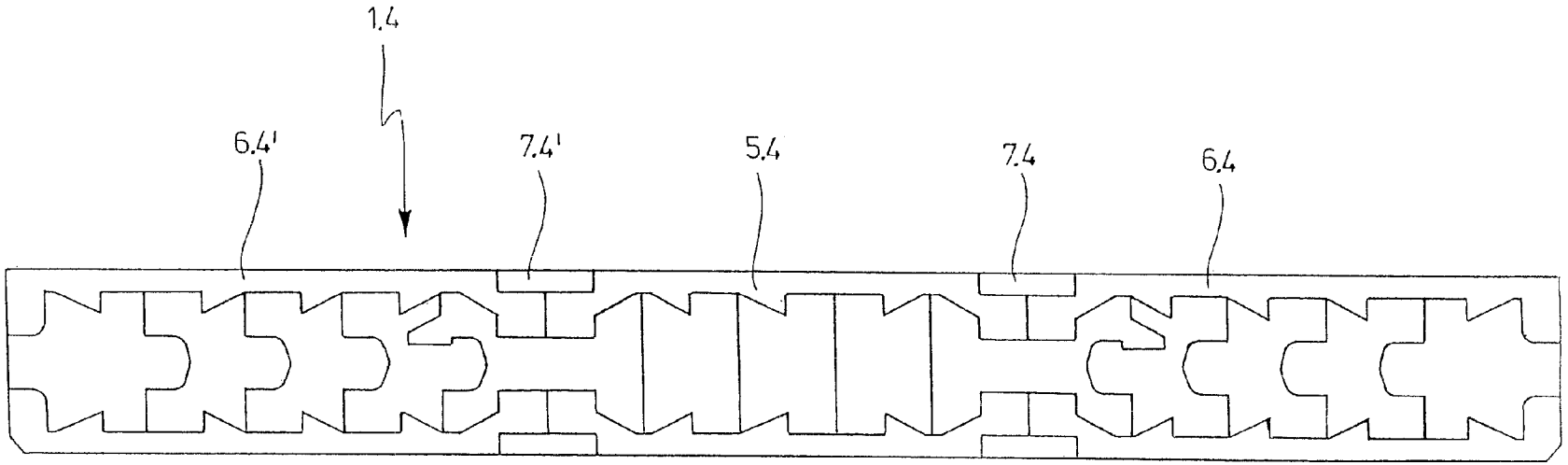
FIG. 8 shows a further template for a device for twenty-four bottles spread out flat in plan view.

The template of FIG. 8 differs from that according to FIG. 5 in detail by the extent of the cutting lines, which define the transverse strips 7.4, 7.4' and the transverse ribs in the longitudinal strips 5.4, 6.4 and 6.4'. As a result, it is achieved that end regions of the longitudinal strips 5.4, 6.4 and 6.4' as well as a few of the transverse ribs project outwardly by approximately the diameter of one container so that correct support is always provided in a packaging sleeve.

Figure 9:
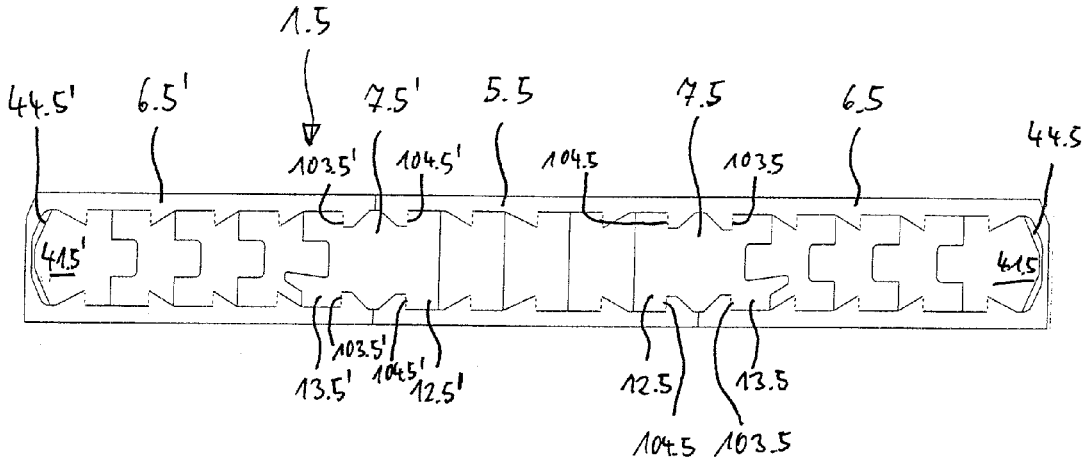
FIG. 9 shows a further template for a device for twenty-four bottles spread out flat in plan view.
Figure 11:
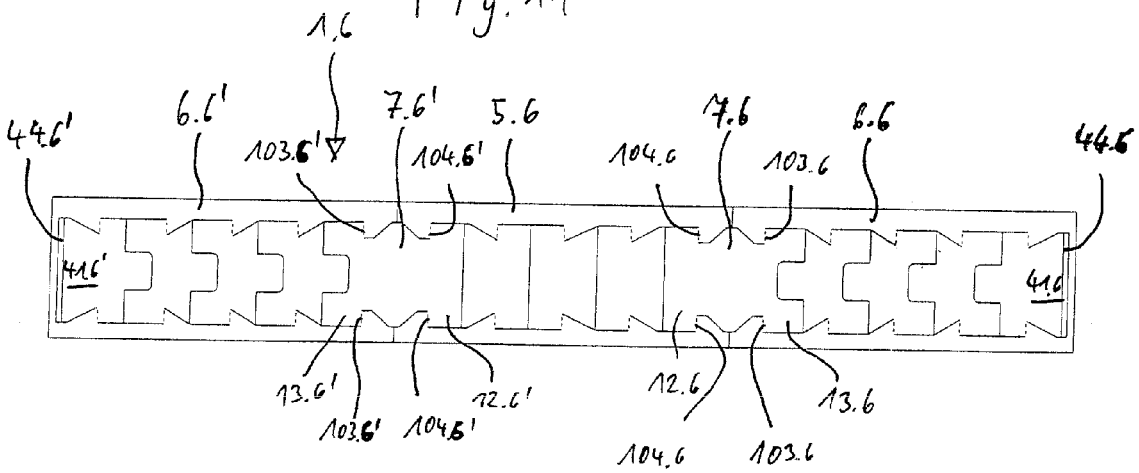
FIG. 11 shows a further template for a device for twenty-four bottles spread out flat in plan view.

The templates according to FIGS. 9 and 11 differ from the aforementioned in particular in that between the longitudinal strips 6.5, 6.5', 5.5, 6.6, 6.6', 5.6 transverse strips 7.5, 7.5', 7.6, 7.6' are arranged which are joined integrally to transverse ribs 12.5, 12.5', 13.5, 13.5', 12.6, 12.6', 13.6, 13.6', which in turn are articulated on the longitudinal strips via first fold lines 103.5, 103.5', 104.5, 104.5', 103.6, 103.6', 104.6, 104.6'. In this case, the joins of the transverse strips to the transverse ribs are located in the region of central interruptions of the first fold lines 103.5, 103.5', 104.5, 104.5', 103.6, 103.6', 104.6, 104.6'.

Moreover, these templates comprise, at the ends of the longitudinal strips 6.5, 6,5', 6.6, 6.6', to which no transverse strips 7.5, 7.5', 7.6, 7.6' are associated, outer transverse ribs 41.5, 41,5', 41.6, 41.6' which are arranged in stamped-out portions of the longitudinal strips which have a gap 44.5, 44.5', 44.6, 44.6' at the outer ends of said transverse ribs. These gaps 44.5, 44.5', 44.6, 44.6' facilitate the folding out of the transverse ribs 41.5, 41.5', 41.6, 41.6'.

Figure 10:
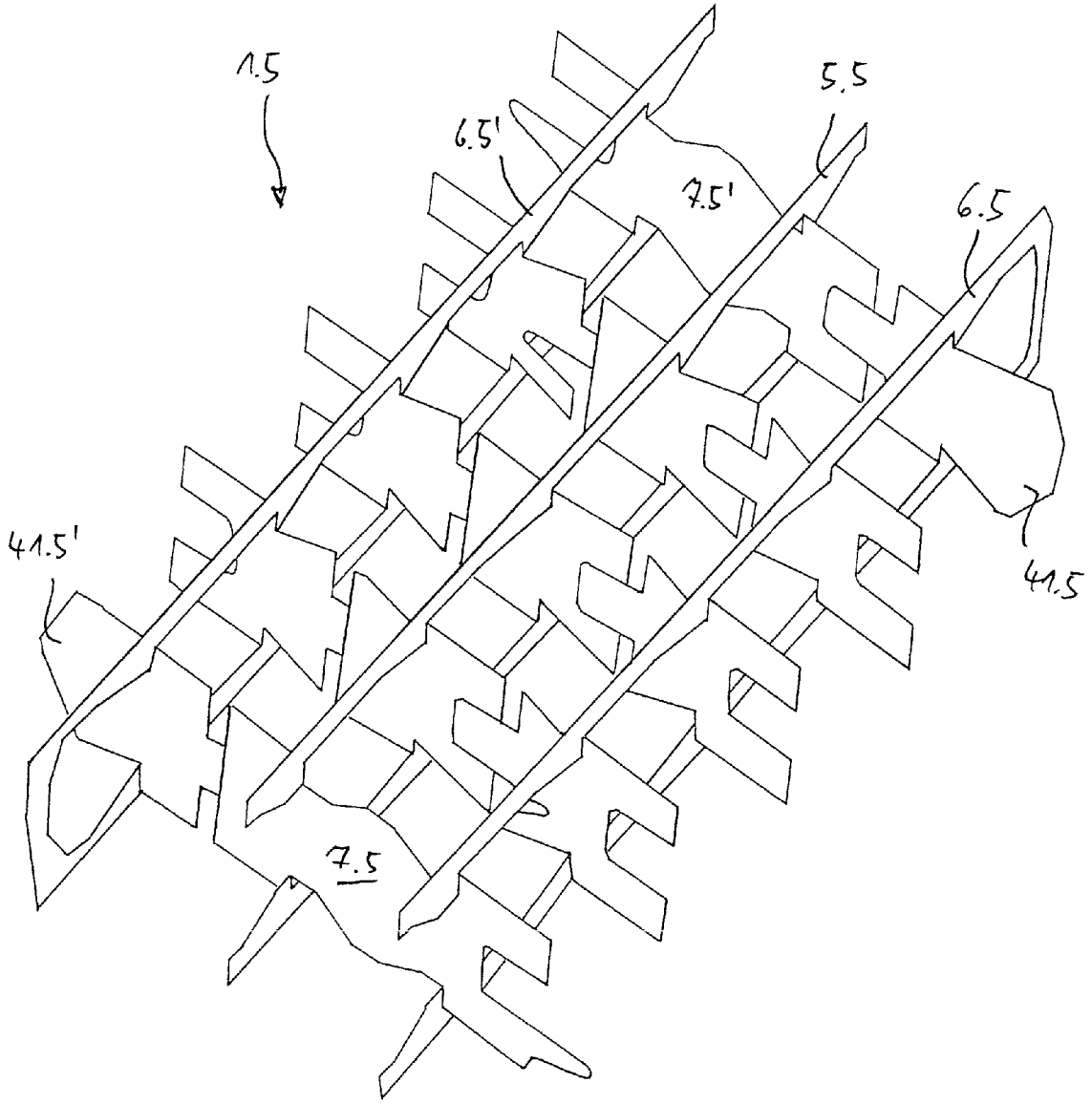
FIG. 10 shows the device formed from the template of FIG. 9 in a perspective view obliquely from above and from the side.
Figure 12:
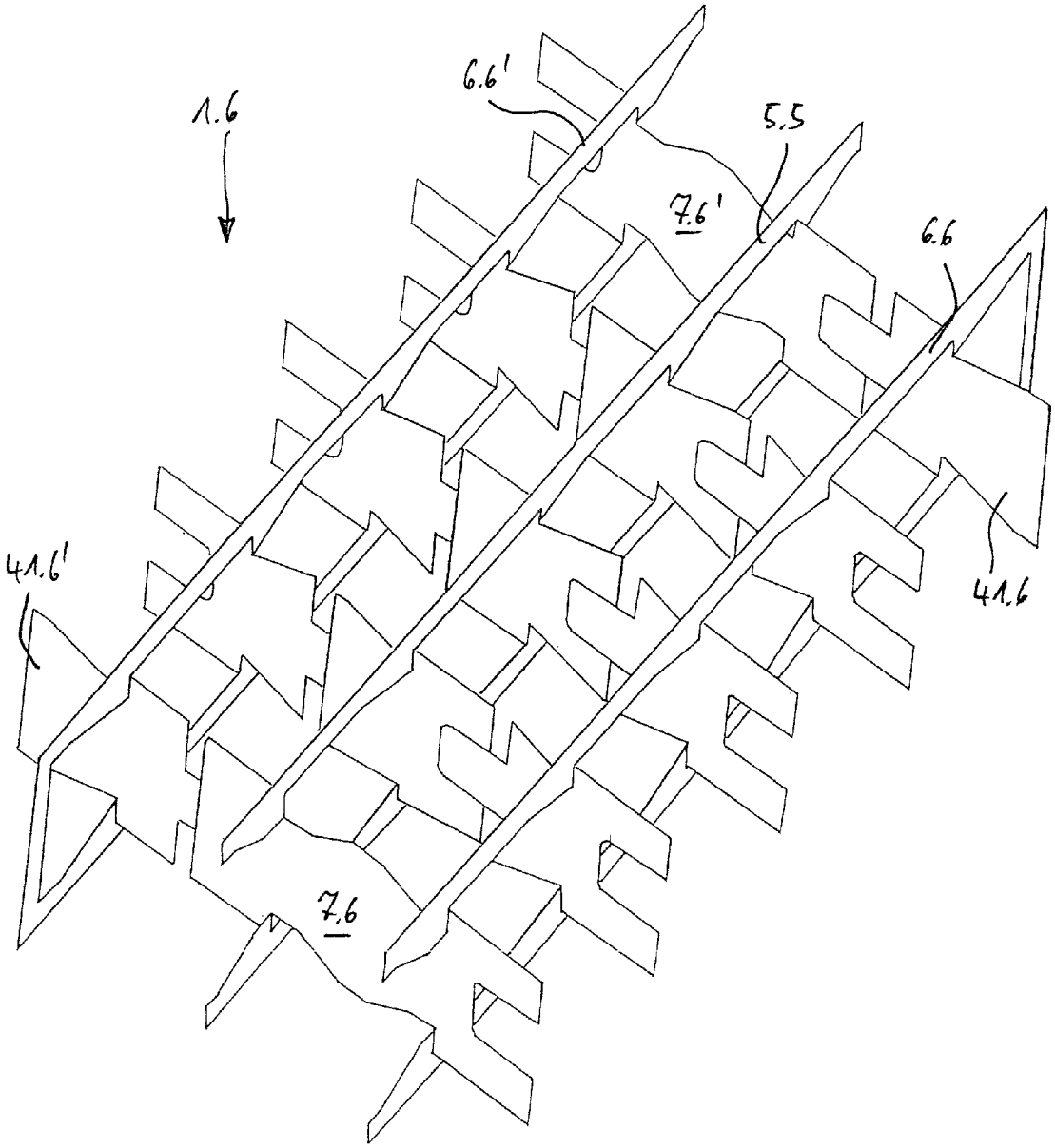
FIG. 12 shows a device formed from the template of FIG. 11 in a perspective view obliquely from above and from the side.

In the embodiment of FIGS. 9 and 10, the aforementioned outer transverse ribs 41.5, 41.5' are outwardly approximately trapezoidal. In the embodiment of FIGS. 11 and 12 the outer transverse ribs 41.6, 41.6' are straight at the outer edges.

The device produced from the template 1.5 of FIG. 9, is shown in FIG. 10. Due to the design of the outer transverse ribs 41.5, 41.5' the device promotes the insertion into an outer in the unfilled state. The device is held by the outer transverse ribs 41.5, 41.5' in the erected position in the outer.

The device formed from the template 1.6 according to FIG. 11, is shown in FIG. 12. The bottles are preferably positioned in the compartments before inserting the device into an outer. The smaller outer transverse ribs 44.6, 44.6' facilitate the insertion into an outer.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A device made from foldable planar material for forming compartments for receiving containers, comprising:

at least two parallel longitudinal strips;

at least one transverse strip foldably connected to the at least two parallel longitudinal strips and being arranged transverse to the at least two parallel longitudinal strips, the at least one transverse strip comprises a medial transverse strip, an upper transverse strip, and a lower transverse strip, the medial transverse strip being arranged between the upper transverse strip and the lower transverse strip, the upper transverse strip and the lower transverse strip are foldably connected to the at least two parallel longitudinal strips;

at least two first transverse ribs foldably connected to the at least two parallel longitudinal strips, the at least two first transverse ribs joined to adjacent longitudinal strips and being joined together in overlapping regions; and at least two second transverse ribs extending outwardly from and being foldably connected to the medial transverse strip and being arranged transverse to the at least two parallel longitudinal strips.

2. The device according to claim 1, in which at least one transverse rib of the at least two first transverse ribs is stamped out from a longitudinal strip of the at least two parallel longitudinal strips.

3. The device according to claim 1, in which at least one overlapping region comprises at least one projection which projects from a transverse rib of the at least two first transverse ribs.

4. The device according to claim 3, in which a complementary stamped-out portion of a transverse rib is associated with the projection which is adjacent to the transverse rib bearing the projection in the same longitudinal strip.

5. The device according to claim 1, in which the at least two first transverse ribs are joined together by bonding.

6. The device according to claim 1, in which the at least two parallel longitudinal strips respectively comprise a plurality of transverse ribs.

7. The device according to claim 1, in which at least one longitudinal strip has at least one end region which projects outwardly relative to the at least one transverse strip.

8. The device according to claim 7, in which the end region projects by a spacing corresponding to the diameter of a container.

9. The device according to claim 1, in which at least one first transverse rib which is joined to an externally arranged longitudinal strip has a maximum overlap over the first fold line joining the at least one first transverse rib to the longitudinal strip which corresponds to the diameter of a container.

10. The device according to claim 9, in which the outer longitudinal strips respectively comprise at least two first transverse ribs with a corresponding overlap.

11. The device according to claim 1 which is folded up so that adjacent longitudinal strips are located on top of one another and the first transverse ribs are folded in at least partially into the longitudinal strips to which they are joined.

12. The device according to claim 1, which defines six, nine, twelve, sixteen, eighteen, twenty or twenty-four compartments.

13. The device according to claim 1 made of cardboard.

14. Packaging comprising a packaging sleeve made from foldable planar material containing at least one device according to claim 1.

15. Packaging according to claim 14, in which the packaging sleeve is substantially cuboid.

16. Packaging according to claim 15, in which the device is joined to the packaging sleeve via tabs on the end face on at least one of the longitudinal strips and the first and second transverse ribs.

17. Packaging according to claim 16, in which the tabs are joined to the packaging sleeve via bonding.

18. Packaging according to claim 14 in which the side walls of the packaging sleeve are joined together by fold lines and the packaging sleeve is folded to form a sleeve which lies flat in which the folded up device is arranged.

19. Packaging according to claim 14, in which the packaging sleeve and the device are aligned.

20. Packaging according to claim 14, in which the packaging sleeve consists of cardboard.

21. Packaging according to claim 14, further comprising containers which are inserted into the compartments formed by the device.

22. Packaging according to claim 21 in which the containers are bottles.

* * * * *